US008085006B2

(12) United States Patent
Burger-Riccio et al.

(10) Patent No.: US 8,085,006 B2
(45) Date of Patent: Dec. 27, 2011

(54) SHUNT REGULATOR

(75) Inventors: Roberta Burger-Riccio, Ottobrunn (DE); Victor da Fonte Dias, Neubiberg (DE)

(73) Assignee: Infineon Technologies AG, Munich (DE)

( * ) Notice: Subject to any disclaimer, the term of this patent is extended or adjusted under 35 U.S.C. 154(b) by 897 days.

(21) Appl. No.: 11/707,562

(22) Filed: Feb. 16, 2007

(65) Prior Publication Data

US 2007/0200536 A1 Aug. 30, 2007

(30) Foreign Application Priority Data

Feb. 17, 2006 (DE) ..... 10 2006 007 479

(51) Int. Cl.
*G05F 1/613* (2006.01)

(52) U.S. Cl. ..... 323/223

(58) Field of Classification Search ..... 323/220, 323/223, 224, 225, 228, 312, 272
See application file for complete search history.

(56) References Cited

U.S. PATENT DOCUMENTS

| | | | | |
|---|---|---|---|---|
| 3,737,572 | A * | 6/1973 | Frizane et al. | 348/730 |
| 4,282,477 | A * | 8/1981 | Ahmed | 323/312 |
| 4,555,660 | A | 11/1985 | von Winnicki | |
| 4,901,002 | A | 2/1990 | Simon | |
| 5,554,924 | A | 9/1996 | McMahon et al. | |
| 6,175,222 | B1 * | 1/2001 | Adams et al. | 323/270 |
| 6,191,645 | B1 * | 2/2001 | Digele | 327/543 |
| 6,713,991 | B1 * | 3/2004 | McCallum | 323/226 |
| 7,095,257 | B2 * | 8/2006 | Whittaker | 327/108 |
| 7,161,338 | B2 * | 1/2007 | Jiang et al. | 323/272 |
| 7,180,279 | B2 * | 2/2007 | Novak | 323/283 |

FOREIGN PATENT DOCUMENTS

| | | |
|---|---|---|
| DE | 1 148 638 | 4/1960 |
| DE | 33 15 393 A1 | 10/1984 |
| DE | 689 07 748 T2 | 2/1994 |
| DE | 42 31 571 A1 | 3/1994 |
| DE | 198 41 972 A1 | 3/2000 |
| DE | 102 13 515 A1 | 12/2003 |

OTHER PUBLICATIONS

Tietze, U., et al., "Halbleiter-Schaltungstechnik: Kennlinien," 2002, pp. 174-177.

* cited by examiner

*Primary Examiner* — Adolf Berhane
*Assistant Examiner* — Yemane Mehari
(74) *Attorney, Agent, or Firm* — Slater & Matsil, L.L.P.

(57) ABSTRACT

A shunt regulator for stepping down an input potential to an output potential, has an input for applying the input potential, an output for tapping off the output potential and a voltage drop circuit, across which the voltage difference between the input potential and the output potential drops. It is possible for the current flowing through the voltage drop circuit or its lower and/or upper limit value to be adjusted.

20 Claims, 4 Drawing Sheets

SHUNT REGULATOR

This application claims priority to German Patent Application 10 2006 007 479.3, which was filed Feb. 17, 2006 and is incorporated herein by reference.

TECHNICAL FIELD

The invention relates to a shunt regulator. In particular the invention relates to a shunt regulator integrated in silicon.

BACKGROUND

Shunt regulators are known from the German laid-open specifications DE 198 41 972 A1, DE 102 13 515 A1 and DE 42 31 571 A1 and are used, for example, for producing a lower regulated output voltage from a high unregulated external input voltage. In addition, a shunt regulator is used for dissipating an excess current from a current source to ground.

In a shunt regulator, the output voltage is regulated to a predetermined value by an amplifier comparing the output voltage to be regulated with a reference voltage and driving a transistor accordingly, the load path of the transistor being connected between the potential of the output voltage to be regulated and ground. The reference voltage is generally provided by a band gap reference circuit. In addition, in a conventional shunt regulator, a nonreactive resistor is connected between the input terminal, to which the unregulated input voltage is applied, and the output terminal, at which the regulated output voltage is tapped off. The voltage difference between the input voltage and the output voltage drops across the resistor.

A shunt regulator needs to be designed for input voltages that are substantially higher than the maximum voltages for which the components of the shunt regulator and the load supplied by the shunt regulator are designed. This applies in particular to integrated shunt regulators. For example, NMOS and PMOS components that have been produced using standard 0.25 μm CMOS technology can only be subjected to voltages of up to 5 V. The input voltages which are applied to the shunt regulator may be up to 15 V, however, and need to be converted by the shunt regulator to an output voltage of, for example, 2.2 V with an accuracy of ±9%.

At the same time, a shunt regulator needs to be capable of meeting the various requirements placed by different load components with regards to power supply. In addition, no static or dynamic overvoltages are allowed to occur at the terminals both of the integrated load components and of the integrated components of the shunt regulator itself. Otherwise, the gate oxides of field effect transistors could break down irreversibly due to high voltages or reverse-biased p-n junctions could collapse. In addition, overvoltages at integrated components could result in a drain-source breakdown or in the properties of the components being impaired owing to so-called hot-electron or latch-up effects.

Furthermore, a shunt regulator needs to ensure safe stepping-up of the system, for which it provides the supply voltage. This is extremely important since the shunt regulator itself is allocated to external assemblies whose supply voltage it produces, such as the abovementioned band gap reference circuit.

A further problem in the design of a shunt regulator is the correct choice of the resistor, which is connected between the input terminal and the output terminal and across which the voltage difference between the input voltage and the output voltage drops. Given a low input voltage, the resistance value of the resistor needs to be sufficiently low for sufficient current to be available to the load and the control loop of the shunt regulator. In contrast, given a high input voltage, the resistance value needs to be comparatively high in order to limit the current flowing through the resistor. Otherwise, the load and the control loop of the shunt regulator could be impaired by an excessively high current.

SUMMARY OF THE INVENTION

One object of the invention is therefore to provide a shunt regulator, in which the current feeding of the load can be matched to the respective requirements of the load.

In one embodiment, a shunt regulator can be used for stepping down an input potential to an output potential. An input terminal applies the input potential and an output terminal taps off the output potential. A voltage drop circuit is connected between the input terminal and the output terminal. During operation of the shunt regulator, the voltage difference between the input potential and the output potential drops so that it is possible for the current flowing through the voltage drop circuit or its limit value to be adjusted.

Advantageous developments and configurations of the invention are also disclosed herein.

BRIEF DESCRIPTION OF THE DRAWINGS

The invention will be explained in more detail below by way of example with reference to the drawings, in which.

DETAILED DESCRIPTION OF ILLUSTRATIVE EMBODIMENTS

Figure 1:
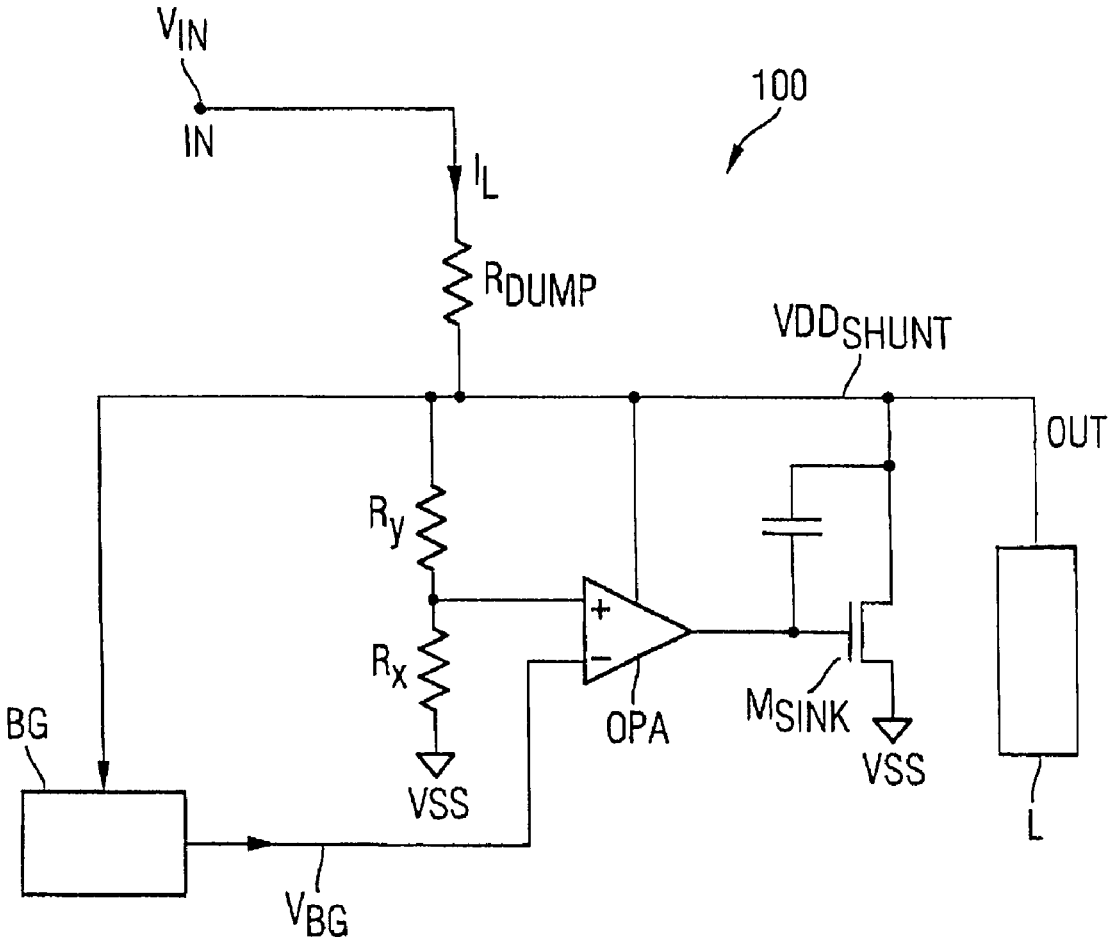
FIG 1 Prior art
FIG. 1 shows a block circuit diagram of a shunt regulator 100 in accordance with the prior art.

Various embodiments of the invention will first be described textually, followed by a description with reference to the figures.

The shunt regulator according to a first embodiment of the invention receives an electrical input potential at an input terminal, produces from this an electrical output potential, by means of a control loop, and provides the regulated output potential at an output terminal. There, it may be used, for example, for supplying voltage to a load connected to the output terminal. In the shunt regulator according to the first embodiment, a voltage drop circuit is connected between the input terminal and the output terminal, across which the voltage drop circuit, during operation of the shunt regulator, the voltage difference between the input potential and the output potential drops. The voltage drop circuit is designed such that the current flowing through it can be adjusted or such that, alternatively, a limit value of this current can be adjusted. The limit value is preferably a lower and/or upper limit value.

Embodiments of the invention are based on the concept that the current flowing through the voltage drop circuit, according to Kirchhoff's laws, represents the total current which flows into the load and into the control loop of the shunt regulator, it also being possible for the load to be a plurality of assemblies or devices connected to the shunt regulator. Consequently, the current feeding the load can be upwardly or downwardly limited by either the current flowing through the voltage drop circuit being adjusted or by the voltage drop circuit being adjusted such that the current flowing through it is limited to a predetermined range.

Typically, the input potential and the output potential of the shunt regulator relates to a common ground. This may also be referred to as an input voltage and an output voltage.

In order to adjust the current flowing through the voltage drop circuit or in order to adjust its limit values, a control unit is preferably provided. The adjustment of the current or its limit values takes place as a function of the input potential applied to the shunt regulator and/or predetermined values for the lower and/or upper limit value. In addition, the adjustment can also be dependent on the potential value to which the output potential is intended to be regulated. The limit values for the permissible current range depend, for example, on requirements of the load connected downstream of the shunt regulator.

One configuration of the voltage drop circuit that is simple to realize represents a nonreactive resistor, which is connected into the current path between the input terminal and the output terminal and whose resistance value can be adjusted. This configuration makes it possible to reduce the current flowing into the control loop and the load at given input and output potentials by increasing the resistance value or to increase this current by reducing the resistance value.

The same effect can also be achieved with a resistor which can be bridged, instead of a resistor with an adjustable resistance. When it is desirable to reduce the current, the resistor is connected into the current path and, when it is desirable to increase the current, the resistor is bridged, with the result that there is no longer a voltage drop across it and, correspondingly, no current flows through it.

Both a resistor with an adjustable resistance and a resistor which can be bridged, which resistors can also be combined with further nonreactive resistors, bring about a linear dependence of the current on the voltage difference between the input potential and the output potential.

If a nonlinear dependence is desired between the current and the voltage difference, a transistor can preferably be connected with its load path into the current path of the voltage drop circuit. In this case, the transistor is driven via its control terminal by the control unit.

Furthermore, a plurality of transistors can be connected with their load paths into the current path. At the same time, additional nonreactive resistors, whose resistance values may be capable of being adjusted or which may be capable of being bridged, can be connected in series with the load paths of the transistors.

In accordance with one configuration of the shunt regulator according to the invention, the transistors connected into the current path are realized by field effect transistors. The field effect transistors are driven, via their gate terminals, by the control unit and are operated in the triode region or in the saturation region, depending on the gate potential.

Triode region is the term used in the specialist literature and, when the drain current is plotted against the drain-source voltage, represents the part of the transistor characteristic at which the characteristic has a virtually linear profile through the origin and there is therefore a response as in the case of a nonreactive resistor. In contrast, the characteristics have a virtually horizontal profile in the saturation region. Saturation region is the term used in the specialist literature. Further details on the triode region and the saturation region can be found in section 3.1.1 of the book "Halbleiter-Schaltungstechnik" [translated as "Semiconductor Circuit Technology"] by U. Tietze and Ch. Schenk, Springer-Verlag, Berlin, 12th edition, 2002, pages 174 to 177, which is hereby incorporated in the disclosure content of the application.

During operation of a field effect transistor in the triode region, only a comparatively low voltage drops between the drain terminal and the source terminal. In this operating state, the field effect transistor operates purely as a switch. With the shunt regulator according to embodiments of the invention, the operation in the triode region is selected when the input potential is low and a sufficiently high current is intended to be made available to the load.

During operation in the saturation region, the field effect transistor produces a substantially larger voltage drop between the drain terminal and the source terminal. In addition, in this case the current flow through the drain-source path can be adjusted by means of the gate potential. The operation in the saturation region is advantageous in the case of a comparatively high input potential.

If a plurality of field effect transistors are connected with their drain-source paths in series between the input terminal and the output terminal, as the input potential increases an increasing number of transistors are switched into the saturation region via their gate potentials, with the result that some of the voltage difference between the input potential and the output potential drops across these transistors. The current flowing through the current path can at the same time be determined by means of a suitable choice of the gate potentials of the field effect transistors.

In accordance with one further configuration of the shunt regulator according to the invention, the control unit compares the input potential or a potential derived from the input potential with a threshold value and, as a function of the result of the threshold value comparison, controls the transistor(s) connected into the current path.

Furthermore, a voltage divider may advantageously be provided which feeds the input potential and which provides subvalues of the input potential at its taps. These subpotentials are passed on as input potentials to the control unit and, on the basis of the subpotentials, the control unit adjusts the current flowing through the voltage drop circuit or its lower and/or upper limit value.

Furthermore, the control unit may be designed such that it compares the subpotentials in each case with a threshold value and, on the basis of the results of these comparisons, determines the operating modes of the individual transistors.

One further configuration of the invention envisages that the control unit increases the gate potential of at least one field effect transistor, if this field effect transistor is being operated in the saturation region, as the input potential increases.

Both the input potential and the output potential are advantageously measured in relation to a common fixed reference potential, in particular a ground potential.

The shunt regulator is preferably integrated monolithically on a common substrate and is produced, for example, by means of CMOS (complementary metal oxide semiconductor) technology.

The control loop, which regulates the output potential to a predetermined value, in the shunt regulator according to an embodiment of the invention is preferably designed as for a conventional shunt regulator. For this purpose, a controllable component, for example a further field effect transistor, is connected with its load path between the output terminal and ground. A control element, for example an operational amplifier, drives the component such that the predetermined output potential is applied to the output terminal.

The control element preferably compares the output potential or a potential derived therefrom with a reference potential and, on the basis of this comparison, generates the control signal for the component. The reference potential can be produced by a band gap reference circuit.

FIG. 1 illustrates the prior art block circuit diagram of a conventional shunt regulator 100 , which can be realized by means of CMOS technology and to which a load L is connected. The shunt regulator 100 has an external input voltage $V_{IN}$ applied to it and converts the input voltage $V_{IN}$ into a regulated output voltage $VDD_{SHUNT}$. For this purpose, the positive potential of the input voltage $V_{IN}$ is applied to an input IN of the shunt regulator 100 , and the positive potential of the output voltage $VDD_{SHUNT}$ can be tapped off at an output OUT. Both the input voltage $V_{IN}$ and the output voltage $VDD_{SHUNT}$ relate to a common ground VSS. In the present example, the output OUT of the shunt regulator 100 is connected to the load L.

A resistor $R_{DUMP}$ is connected between the input IN and the output OUT. The voltage difference between the input voltage $V_{IN}$ and the output voltage $VDD_{SHUNT}$ drops across the resistor $R_{DUMP}$.

In order to regulate the output voltage $VDD_{SHUNT}$, the shunt regulator 100 has an operational amplifier OPA, an n-channel field effect transistor $M_{SINK}$, resistors $R_x$ and $R_y$ and a band gap reference circuit BG. The operational amplifier OPA has the circuitry of a non-inverting amplifier. For this purpose, the resistors $R_x$ and $R_y$ are arranged in series, and this series circuit, as illustrated in FIG. 1, is connected between the output OUT and ground VSS. The node located between the resistors $R_x$ and $R_y$ is connected to the non-inverting input of the operational amplifier OPA. The inverting input of the operational amplifier OPA has a reference voltage $V_{BG}$ applied to it by the band gap reference circuit BG, which reference voltage is stable with respect to temperature, process and supply voltage fluctuations. The output of the operational amplifier OPA is connected to the gate terminal of the field effect transistor $M_{SINK}$. The drain-source path of the field effect transistor $M_{SINK}$ is connected between the output OUT and ground VSS. In addition, the supply terminals of the operational amplifier OPA and of the band gap reference circuit BG have the output voltage $VDD_{SHUNT}$ applied to them for voltage supply purposes.

The operational amplifier OPA, which is generally realized in the form of a single-stage transconductance amplifier, owing to its external circuitry, drives the field effect transistor $M_{SINK}$, which is operated as the output stage, such that an output voltage $VDD_{SHUNT}$ is set in accordance with the following equation:

$$VDD_{SHUNT} = \left(1 + \frac{R_y}{R_x}\right) \cdot V_{BG} \tag{1}$$

In addition, an excessive current is dissipated to ground VSS via the drain-source path of the field effect transistor $M_{SINK}$.

As has already been described above, the voltage difference between the input voltage $V_{IN}$ and the output voltage $VDD_{SHUNT}$ drops across the resistor $R_{DUMP}$. This has a particularly critical significance when the value of the input voltage $V_{IN}$ is greater than the maximum permissible voltage of the components of the load L or of the shunt regulator 100 . A current $I_L$, which, according to Kirchhoff's laws, represents the sum of the currents flowing into the control loop, the band gap reference circuit BG and the load L, flows through the resistor $R_{DUMP}$. The current $I_L$ can be determined in accordance with the following equation:

$$I_L = \frac{1}{R_{DUMP}} \cdot (V_{IN} - VDD_{SHUNT}) \tag{2}$$

The current $I_L$ needs to be sufficiently high to provide the currents required by the control loop, the band gap reference circuit BG and the load L and to bias the field effect transistor $M_{SINK}$.

Figure 2:
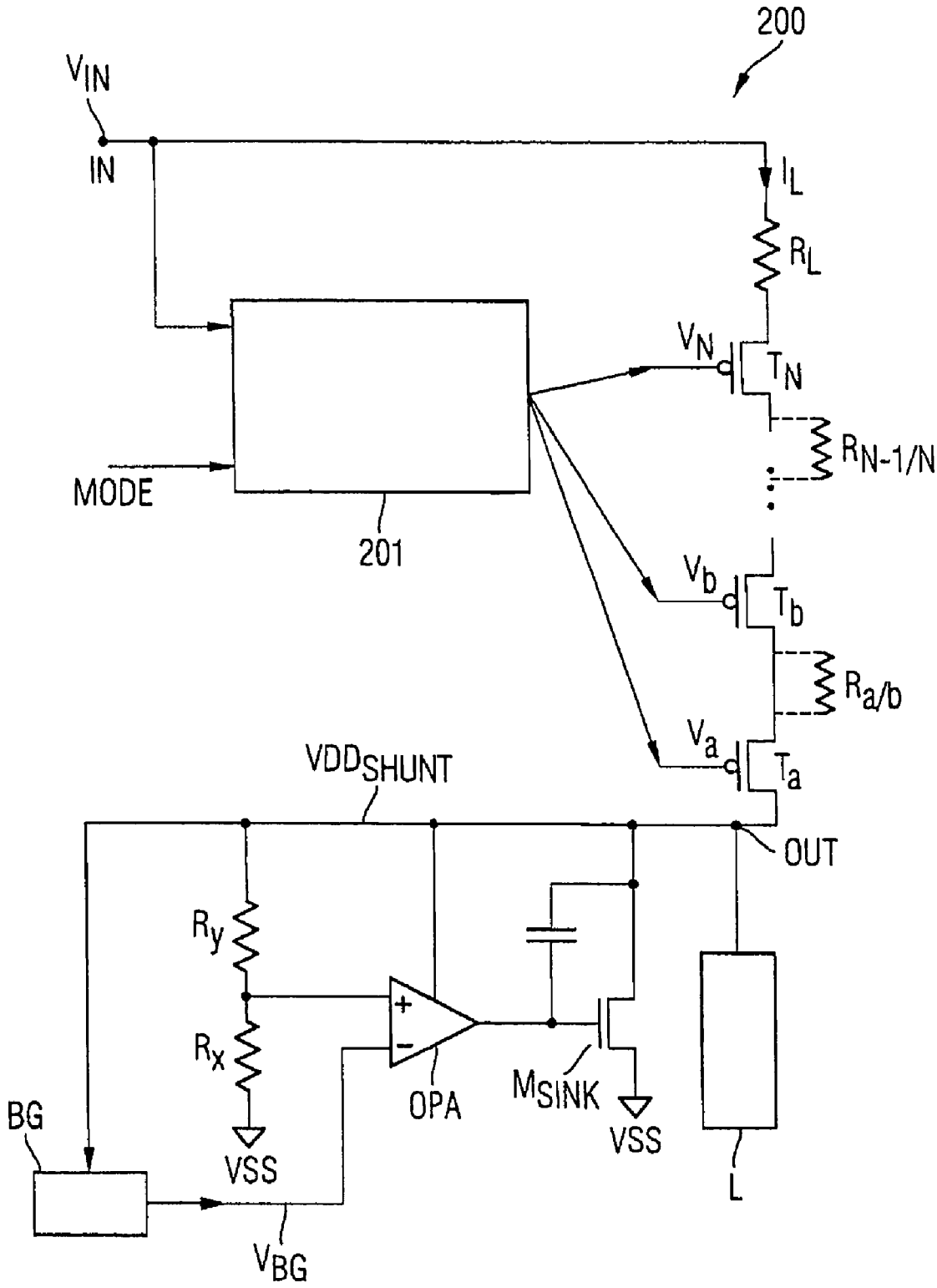
FIG. 2 shows a block circuit diagram of a shunt regulator 200 as a first exemplary embodiment of the shunt regulator according to the invention.

FIG. 2 illustrates, as a first exemplary embodiment of the invention, the block circuit diagram of a shunt regulator 200 , which can be realized by means of CMOS technology and to which a load L is connected. The control loop constructed around the operational amplifier OPA for regulating the output voltage $VDD_{SHUNT}$ to a predetermined value corresponds to the control loop of the shunt regulator 100 shown in FIG. 1. Mutually corresponding components in FIGS. 1 and 2 are therefore identified by the same reference symbols. The same also applies to the exemplary embodiments described further below of the invention shown in FIGS. 3 and 4.

In contrast to the conventional shunt regulator 100 shown in FIG. 1, in the shunt regulator 200 illustrated in FIG. 2, a series circuit comprising a nonreactive resistor $R_L$ and p-channel field effect transistors $T_a, T_b, \ldots, T_N$ is provided in place of the nonreactive resistor $R_{DUMP}$. The resistor $R_L$ is in this case connected downstream of the input IN, and the field effect transistors $T_N$ to $T_a$ are arranged downstream of the resistor $R_L$ with their drain-source paths in series.

The gate terminals of the field effect transistors $T_a$ to $T_N$ are driven by a control unit 201 . The control voltages which are applied to the gate terminals of the field effect transistors $T_a$ to $T_N$ are provided with the reference symbols $V_a$ to $V_N$. On the input side, the control unit 201 is fed the input voltage $V_{IN}$ and a control signal MODE.

The operating mode of the load L is communicated to the control unit 201 by means of the control signal MODE. In particular, in this case the minimum load current required by the load L is communicated to the control unit 201 as is the maximum load current which should be fed to the load. Using this information and/or the input voltage $V_{IN}$ applied to the shunt regulator 200 , the control unit 201 decides upon the driving of the field effect transistors $T_a$ to $T_N$. The aim here is to meet the requirements with respect to the minimum and maximum load current and to ensure reliable stepping-up of the load L and sufficient overvoltage protection.

In the present exemplary embodiment, the field effect transistors $T_a$ to $T_N$, in order to fulfil the abovementioned tasks, are either operated in the triode region or in the saturation region. Given a low input voltage $V_{IN}$, the control unit 201 chooses the control voltages $V_a$ to $V_N$ such that the field effect transistors $T_a$ to $T_N$ are in the triode region. In this operating state, a relatively low voltage drops across the drain-source paths of the field effect transistors $T_a$ to $T_N$. As the input voltage $V_{IN}$ increases, the field effect transistors $T_a$ to $T_N$ are gradually switched to the saturation region. This operating state brings about a relatively high voltage drop between the drain and source terminals of the individual field effect transistors $T_a$ to $T_N$. This ensures that a voltage is applied to each individual field effect transistor $T_a$ to $T_N$ which is lower than the breakdown voltage. In addition, this operating state of the field effect transistors $T_a$ to $T_N$ causes the current $I_L$ to be limited.

In addition to the resistor $R_L$, further resistors may be provided which are connected in series with the resistor $R_L$ and the field effect transistors $T_a$ to $T_N$ and in particular have an adjustable resistance value or can be bridged.

Figure 3:
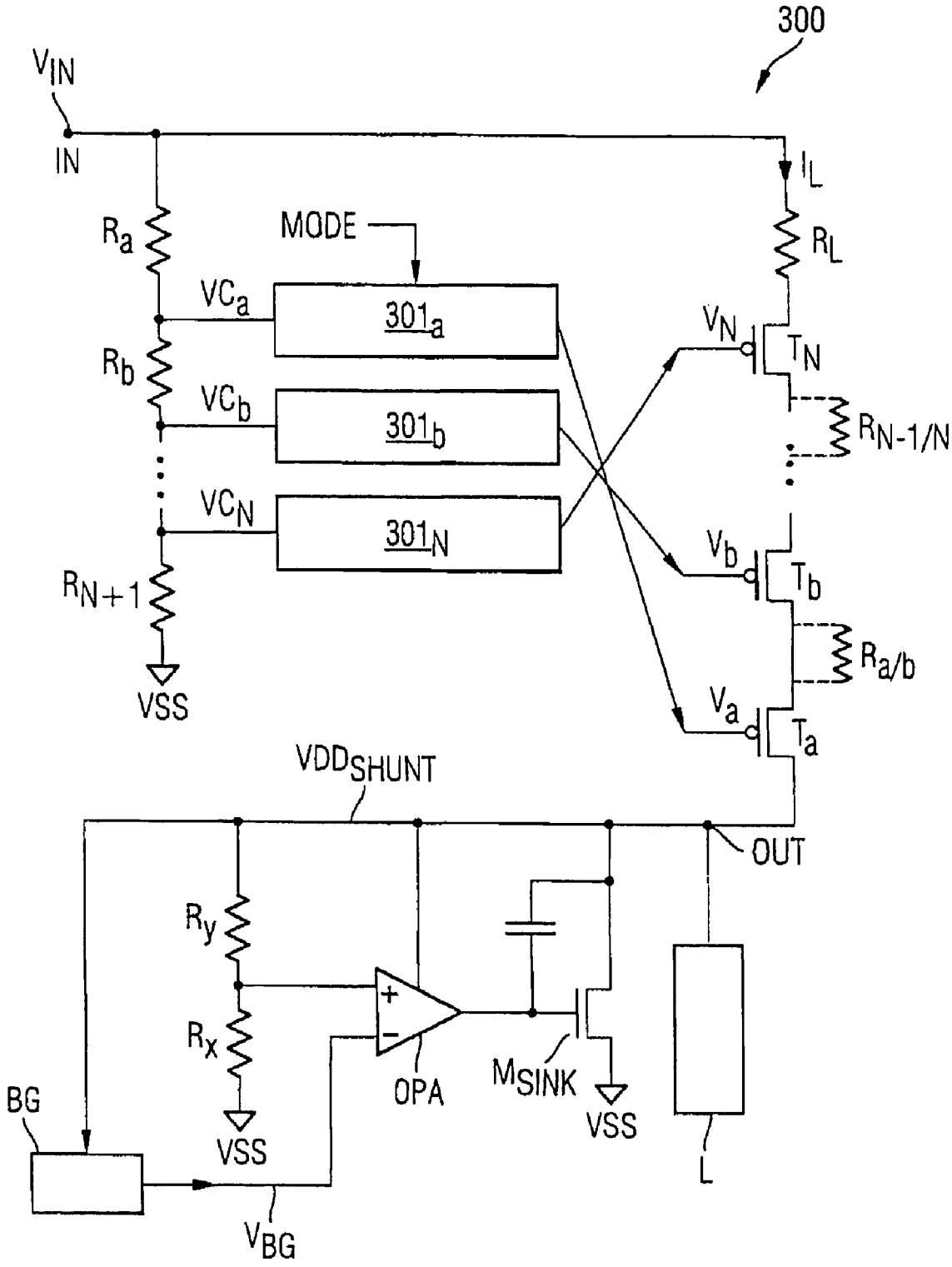
FIG. 3 shows a block circuit diagram of a shunt regulator 300 as a second exemplary embodiment of the shunt regulator according to the invention.

FIG. 3 illustrates, as a second exemplary embodiment of the invention, the block circuit diagram of a shunt regulator 300 , in which the principle shown in FIG. 2 is provided with a further configuration. For this purpose, the control unit 201 is illustrated in more detail in FIG. 3.

In the shunt regulator 300 , a control unit $\mathbf{301}_a$, $\mathbf{301}_b$, . . . or $\mathbf{301}_N$ is associated with each of the field effect transistors $T_a$ to $T_N$, which control unit takes on the function of controlling the respective field effect transistor $T_a$ to $T_N$. The control units $\mathbf{301}_a$ to $\mathbf{301}_N$ are fed, on the input side, in addition to the control signal MODE, a control voltage $VC_a$, $VC_b$, . . . or $VC_N$. The control voltages $VC_a$ to $VC_N$ are produced by means of a series circuit comprising resistors $R_a$, $R_b$, . . . , $R_{N+1}$. The resistors $R_a$ to $R_{N+1}$ are arranged in series, as illustrated in FIG. 3, and the resulting series circuit is connected between the input IN of the shunt regulator 300 and ground VSS. The nodes positioned between in each case two adjacent resistors $R_a$ to $R_{N+1}$ form the taps for the control voltages $VC_a$ to $VC_N$.

Each of the control units $\mathbf{301}_a$ to $\mathbf{301}_N$ compares the control voltage $VC_a$ to $VC_N$ applied to its input with a predetermined threshold value voltage $V_{thresh}$. If the respective control voltage $VC_a$ to $VC_N$ is lower than the threshold value voltage $V_{thresh}$ and the control signal MODE has a predetermined value, the relevant control unit $\mathbf{301}_a$ to $\mathbf{301}_N$ drives the field effect transistor $T_a$ to $T_N$ associated with it such that it is operated in the triode region. If the control voltage $VC_a$ to $VC_N$ exceeds the threshold value voltage $V_{thresh}$ and the control signal MODE has a predetermined value, the relevant control unit $\mathbf{301}_a$ to $\mathbf{301}_N$ switches the field effect transistor $T_a$ to $T_N$ driven by it into the saturation region.

The current $I_L$, which flows through the series circuit formed from the resistor $R_L$ and the field effect transistors $T_a$ to $T_N$, is determined by the voltage difference $V_{IN}$-$VDD_{SHUNT}$, by the resistance value of the resistor $R_L$ and the operating states of the field effect transistors $T_a$ to $T_N$. Given the maximum permissible input voltage $V_{IN}$, all of the field effect transistors $T_a$ to $T_N$ are operated in the saturation region, and the current $I_L$ is determined by the voltage drop across the resistor $R_L$.

The maximum input voltage $V_{IN}$ which should be applied to the shunt regulator 300 is N-times the breakdown voltage $V_{breakdown}$ of the technology used for producing the load L and the shunt regulator 300. For example, the breakdown voltage $V_{breakdown}$ for a standard 0.25 μm CMOS technology is 5 V.

When choosing the control voltages $V_a$ to $V_N$ for controlling the field effect transistors $T_a$ to $T_N$, care must be taken that the voltage difference between the gate voltages of two adjacent field effect transistors $T_a$ to $T_N$ is typically no greater than the breakdown voltage $V_{breakdown}$ should be. For example, the control voltage $V_a$ is either 0 V or $VDD_{SHUNT}$ and the control voltage $V_b$ is either 0 V or $VDD_{SHUNT}$+ $0.8*V_{breakdown}$.

In FIGS. 2 and 3, resistors $R_{a/b}$, . . . , $R_{N-1/N}$ are illustrated by means of dashed lines between in each case two adjacent field effect transistors $T_a$ to $T_N$. The resistors $R_{a/b}$ to $R_{N-1/N}$ can be provided optionally and should also contribute to preventing overvoltages between the drain and source terminals.

Figure 4:
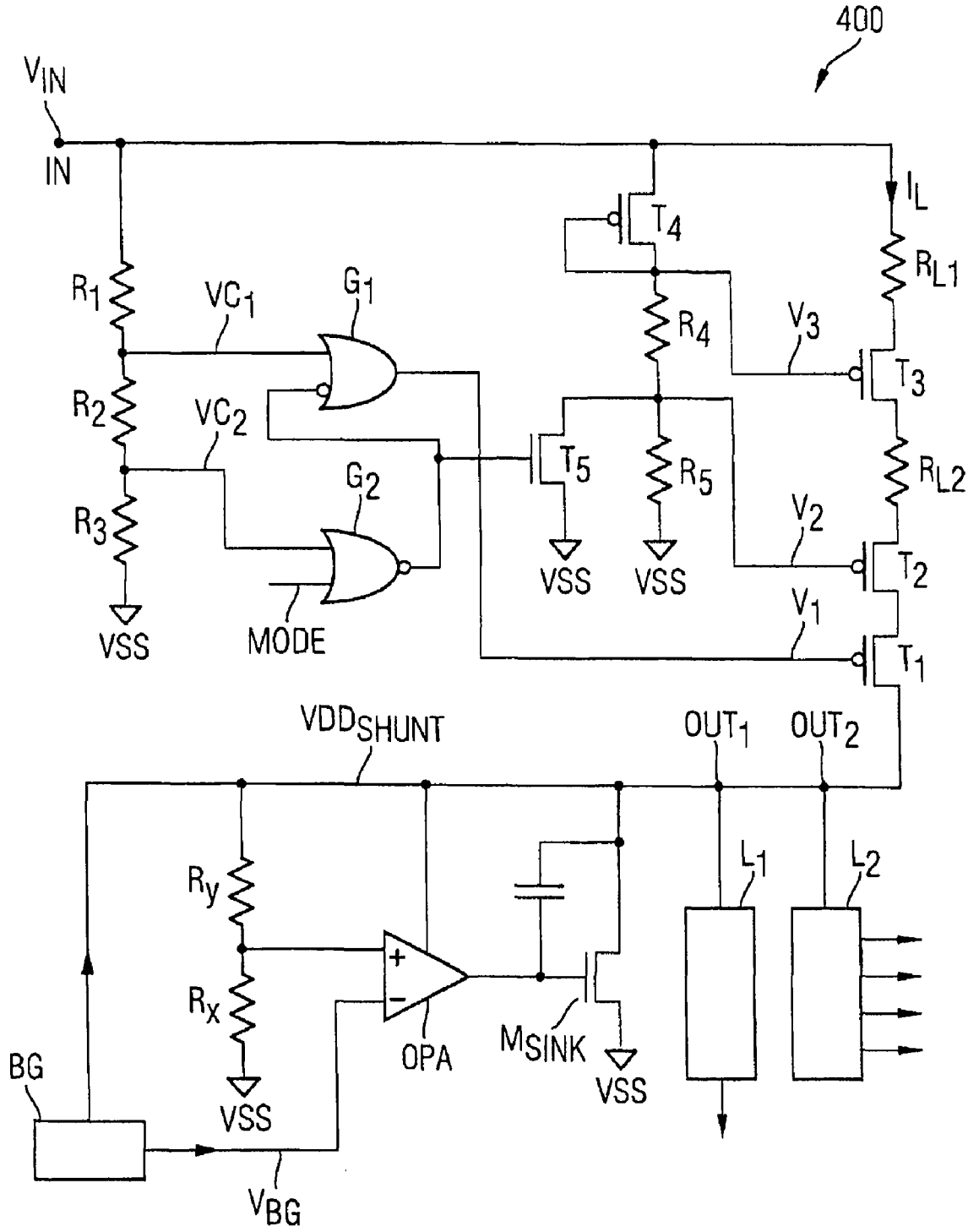
FIG. 4 shows a block circuit diagram of a shunt regulator 400 as a third exemplary embodiment of the shunt regulator according to the invention.

FIG. 4 illustrates, as a third exemplary embodiment of the invention, the block circuit diagram of a shunt regulator 400. Loads $L_1$ and $L_2$ are connected to outputs $OUT_1$ and $OUT_2$ of the shunt regulator 400. Resistors $R_{L1}$ and $R_{L2}$ and p-channel field effect transistors $T_1$, $T_2$ and $T_3$ are connected in series between the input IN and the outputs $OUT_1$ and $OUT_2$. The current $I_L$, which feeds the control loop, the band gap reference circuit BG and the loads $L_1$ and $L_2$, is limited by means of the mentioned components, and the voltage difference $V_{IN}$-$VDD_{SHUNT}$ is produced. A voltage divider, which is formed from resistors $R_1$, $R_2$ and $R_3$ and is connected between the input IN and ground VSS, serve the purpose, together with the control signal MODE, of adjusting the gate voltages $V_1$, $V_2$ and $V_3$ of the field effect transistors $T_1$, $T_2$ and $T_3$.

A circuit, which determines the gate voltages $V_1$, $V_2$ and $V_3$ from the input voltage $V_{IN}$, the control voltages $VC_1$, and $VC_2$ and the control signal MODE, is arranged between the voltage divider, comprising the resistors $R_1$, $R_2$ and $R_3$, and the series circuit comprising the components $R_{L1}$, $R_{L2}$, $T_1$, $T_2$ and $T_3$. This circuit comprises an OR gate $G_1$, a NOR gate $G_2$, a p-channel field effect transistor $T_4$, an n-channel field effect transistor $T_5$ and resistors $R_4$ and $R_5$.

The inputs of the OR gate $G_1$ are connected to the nodes between the resistors $R_1$ and $R_2$ or to the output of the NOR gate $G_2$. Care should be taken that the output signal of the NOR gate $G_2$ is inverted at the input of the OR gate $G_1$. The output of the OR gate $G_1$ is connected to the gate terminal of the field effect transistor $T_1$. One input of the NOR gate $G_2$ is connected to the node between the resistors $R_2$ and $R_3$, while the other input of the NOR gate $G_2$ is driven by the control signal MODE.

The transistor $T_4$ has the circuitry of a diode due to the connection of its gate terminal to its source terminal. The drain terminal of the transistor $T_4$ is connected to the input IN, and both one terminal of the resistor $R_4$ and the gate terminal of the transistor $T_3$ are coupled to its source terminal. The other terminal of the resistor $R_4$ is connected to the drain terminal of the transistor $T_5$ to one terminal of the resistor $R_5$ and to the gate terminal of the transistor $T_2$. The source terminal of the transistor $T_5$ and the other terminal of the resistor $R_5$ are connected to ground VSS.

The manner in which the shunt regulator 400 functions is as follows. The shunt regulator 400 is designed for a maximum input voltage $V_{IN}$ of 15 V. The control loop of the shunt regulator 400 is set such that the output voltage $VDD_{SHUNT}$ is 2.2 V. At an input voltage $V_{IN}$ below 4 V, the ground potential VSS is present at all of the gate terminals of the field effect transistors $T_1$, $T_2$ and $T_3$, and the field effect transistors $T_1$, $T_2$ and $T_3$ are correspondingly in the triode region. In this state, the current $I_L$, which feeds the control loop, the band gap reference circuit and the loads $L_1$ and $L_2$, is determined by the resistors $R_{L1}$ and $R_{L2}$ and can be calculated by means of the term $(V_{IN}-VDD_{SHUNT})/(R_{L1}+R_{L2})$.

At an input voltage $V_{IN}$ of 4 V, the OR gate $G_1$ changes its output voltage $V_1$ from 0 V to 2.2 V. As a result, the field effect transistor $T_1$ transfers to the saturation region, while the field effect transistors $T_2$ and $T_3$ remain in the triode region. In this state, an increased voltage drops across the drain-source path of the field effect transistor $T_1$. In addition, the current $I_L$ is no longer determined by the resistors $R_{L1}$ and $R_{L2}$ alone, but also by the gate voltage $V_1$.

At an input voltage $V_{IN}$ of 7 V, the output voltage of the NOR gate $G_2$ changes from 0 V to 2.2 V. This means that the field effect transistors $T_2$ and $T_3$ also change over to the saturation region. At an input voltage $V_{IN}$ of 7 V, the gate voltages $V_1$, $V_2$ and $V_3$ are 2.2 V, 4 V and 5 V, respectively. The voltage drop between the input voltage $V_{IN}$ and the output voltage $VDD_{SHUNT}$ is now distributed among the resistors $R_{L1}$ and $R_{L2}$ and all of the field effect transistors $T_1$, $T_2$ and $T_3$. The current $I_L$ is determined by the resistors $R_{L1}$ and $R_{L2}$ and the gate voltages $V_1$, $V_2$ and $V_3$.

At an input voltage $V_{IN}$ of between 7 V and 15 V, the only difference from the previous case is that the gate voltages $V_2$ and $V_3$, which are produced by the voltage divider comprising the resistors $R_4$ and $R_5$, increase approximately linearly with the input voltage $V_{IN}$.

The response of the field effect transistors $T_1$, $T_2$ and $T_3$ is furthermore determined by the control signal MODE. The control signal MODE may assume two states and is produced by an external control unit. In the present exemplary embodiment, it is decided by means of the control signal MODE whether the load $L_1$ is connected to the shunt regulator 400 or not. In the present exemplary embodiment, the load $L_1$ requires a relatively high current of 250 μA, while the load $L_2$ requires a current of 50 μA and the control loop together with the band gap reference circuit BG require a current of approximately 39.5 μA. Accordingly, the minimum required current $I_L$ in the case of an unconnected load $L_1$ is 150 μA and the maximum permissible current $I_L$ is 400 μA. In this case, the input voltage $V_{IN}$ is in a range of about 3.0 V to 3.9 V or in a range of about 4.3 V to 5.3 V, depending on the operating mode. For the case in which the load $L_1$ is intended to be supplied by the shunt regulator 400 , the minimum current $I_L$ which needs to be made available is 350 μA, while the maximum current $I_L$ of 1 mA should not be exceeded. In this case, the input voltage $V_{IN}$ is in a range of from 4.3 V to 5.3 V or in a range of from 5.6 V to 15.0 V, depending on the operating mode.

What is claimed is:

1. A shunt regulator for stepping down an input potential to an output potential, the shunt regulator comprising:

an input terminal for applying the input potential between the input terminal and a common fixed potential;

an output terminal for tapping off the output potential between the output terminal and the common fixed potential, the output potential being regulated; and a voltage drop circuit comprising at least one transistor having a load path, at least one nonreactive resistor coupled into a current path of the voltage drop circuit, the at least one nonreactive resistor having an adjustable resistance value, wherein the voltage drop circuit is coupled in series between the input terminal and the output terminal, during operation of the shunt regulator, a voltage difference between the input potential and the output potential drops across the voltage drop circuit, and a current flowing through the voltage drop circuit or a limit value of the current flowing through the voltage drop circuit is adjustable.

2. The shunt regulator according to claim 1, further comprising:

a control unit for causing the current flowing through the voltage drop circuit to be adjusted or for causing the limit value of the current flowing through the voltage drop circuit to be adjusted, the adjustments taking place as a function of the input potential and/or at least one predetermined value for the limit value.

3. The shunt regulator according to claim 1, wherein the at least one nonreactive resistor comprises at least one bridgeable resistor coupled into a current path of the voltage drop circuit.

4. The shunt regulator according to claim 1, wherein the common fixed potential comprises a ground potential.

5. The shunt regulator according to one claim 1, wherein the shunt regulator is integrated monolithically on a substrate.

6. The shunt regulator according to claim 1, further comprising:

a controllable component comprising a load path coupled between the output terminal and the common fixed potential; and a control element configured to drive the controllable component such that a predetermined output potential is applied to the output terminal.

7. The shunt regulator according to claim 1, wherein the adjustable limit value of the current flowing through the voltage drop circuit comprises a lower and/or upper limit value.

8. The shunt regulator according to claim 2, wherein:

the load path is coupled into a current path of the voltage drop circuit; and the at least one transistor comprises a control terminal driven by the control unit.

9. The shunt regulator according to claim 8, wherein the at least one transistor comprises at least one field effect transistor.

10. The shunt regulator according to claim 8, wherein the control unit is configured to:

compare the input potential or a potential derived from the input potential with a threshold value; and drive the at least one transistor as a function of the comparison with the threshold value.

11. The shunt regulator of claim 9, wherein the field effect transistor is configured to be optionally operated in a triode region or in a saturation region.

12. The shunt regulator according to claim 9, further comprising a voltage divider that divides the input potential into at least one subpotential, wherein the control unit adjusts the current flowing through the voltage drop circuit or the limit value of the current flowing through the voltage drop circuit as a function of the, at least one subpotential.

13. The shunt regulator according to claim 12, wherein the control unit is configured to:

compare the at least one subpotential with a threshold value; and drive the at least one transistor as a function of a comparison with the threshold value.

14. The shunt regulator according to claim 12, wherein the control unit is configured to increase a gate potential of the at least one field effect transistor as the input potential increases if the at least one field effect transistor is operated in the saturation region.

15. The shunt regulator according to claim 6, wherein the control element is configured to:

compare the output potential or a potential derived from the output potential with a reference potential; and drive the controllable component as a function of a comparison with the reference potential.

16. The shunt regulator according to claim 6, wherein:

the controllable component comprises a field effect transistor; and the control element comprises an operational amplifier, the operational amplifier comprising an output coupled to a gate of the field effect transistor.

17. A method of operating a shunt regulator comprising an input terminal, an output terminal, and a common terminal, the method comprising:

comparing a potential between the input terminal and the common terminal of the shunt regulator with a predetermined threshold;

adjusting a resistance of a voltage drop circuit based on comparing the potential at the input terminal, the voltage drop circuit coupled in series between the input terminal and the output terminal of the shunt regulator; and regulating an output potential between the output terminal and the common terminal, regulating comprising controlling a shunt regulation transistor coupled in shunt with the output terminal, the controlling comprising comparing a potential at the output terminal with a reference voltage and adjusting a current through the shunt regulation transistor based on the comparing the potential at the output terminal.

18. The method of claim 17, wherein;

the voltage drop circuit comprises at least one MOS transistor and at least one resistor coupled in series; and adjusting the resistance comprises adjusting a gate voltage of the at least one MOS transistor.

19. The method of claim 17, wherein:

comparing the potential at the input terminal comprises comparing the potential at the input terminal through a first voltage divider circuit; and comparing the potential at the output terminal comprises comparing the potential at the output terminal through a second voltage divider circuit.

20. A semiconductor shunt regulator circuit comprising:

a voltage drop circuit coupled between an input terminal and an output terminal of the semiconductor shunt regulator circuit, the voltage drop circuit comprising an adjustable resistor comprising at least one transistor and at least one resistor coupled in series, a first voltage divider circuit coupled to the input terminal of the semiconductor shunt regulator circuit, a control circuit configured to control the adjustable resistor based on an output of the first voltage divider circuit; and a shunt regulation circuit configured to regulate an output potential between the output terminal and a common terminal, the shunt regulation circuit comprising a shunt transistor comprising an output terminal coupled between the output terminal and the common terminal of the semiconductor shunt regulator circuit; and an operational amplifier comprising an output coupled to a control terminal of the shunt transistor, a first input coupled to a second voltage divider circuit, wherein the second voltage divider circuit is further coupled to the output terminal of the semiconductor shunt regulator circuit, and a second input coupled to a reference voltage.

* * * * *